United States Patent [19]

Takada

[11] Patent Number: 4,725,805

[45] Date of Patent: Feb. 16, 1988

[54] ELECTRIC CURRENT CONTROL TYPE VARIABLE INDUCTOR

[75] Inventor: Noboru Takada, Tsurugashima, Japan

[73] Assignee: Toko Kabushiki Kaisha, Tokyo, Japan

[21] Appl. No.: 943,780

[22] Filed: Dec. 19, 1986

[30] Foreign Application Priority Data

| | | | |
|---|---|---|---|
| Dec. 25, 1985 | [JP] | Japan | 60-295876 |
| Jan. 23, 1986 | [JP] | Japan | 61-8070[U] |
| Jan. 27, 1986 | [JP] | Japan | 61-10080[U] |
| Jan. 27, 1986 | [JP] | Japan | 61-10081[U] |
| Jan. 29, 1986 | [JP] | Japan | 61-11423[U] |

[51] Int. Cl.[4] ..... H01F 15/02; H01F 21/06

[52] U.S. Cl. ..... 336/83; 336/119; 336/136; 336/212

[58] Field of Search ..... 336/212, 83, 136, 214, 336/215, 119, 118, 117, 129; 334/12

[56] References Cited

U.S. PATENT DOCUMENTS 4,630,013 12/1986 Takada ..... 336/83

*Primary Examiner*—Thomas J. Kozma

*Attorney, Agent, or Firm*—Stevens, Davis, Miller & Mosher

[57] ABSTRACT

The construction of cores in an electric-current-controlled type variable inductor used in radio receivers is disclosed. The inductors have three or four cores. In the case of the variable inductors of the type having three cores, the winding portion of a first core is formed with a hollow portion, a second core is inserted into the hollow portion in such a way that the winding portion of the second core can be maintained in parallel with the winding portion of the first core, the first core is inserted into a pot-shaped third core in such a way that the winding portion of the first core can be maintained perpendicular to the bottom of the third core and the magnetic path established by a control coil mounted on the first core and the magnetic path established by a tuning coil mounted on the second core are superimposed one upon another around the winding portion of the second core. According to the present invention, the second core through which is extended the magnetic path established by the tuning coil and a part or means for substantially covering the second core are made of a high-frequency material (or a material best adapted to operate at a high frequency) while the remaining parts through which is extended the magnetic path established by the control coil is made of a low-frequency material (or a material best adapted to operate at a low frequency). Furthermore, in the case of variable conductors each having four cores, a fourth core is made of a high-frequency material, confines the magnetic path established by the tuning coil and is so disposed as to cover the second core in the hollow portion.

9 Claims, 14 Drawing Figures

ELECTRIC CURRENT CONTROL TYPE VARIABLE INDUCTOR

BACKGROUND OF THE INVENTION

1. Technical Field

The present invention relates to an electric-current-control type variable inductor which is used in electronic tuning circuits such as car radio tuners.

2. Background Arts and its Problems

FIG. 3 is a view used to explain a prior art electric-current-control type variable inductor which has been applied by the same applicant (Japanese Patent Application No. 59-14822).

A first core 1 is mounted with a control coil 2 and a second core 5 mounted with a tuning coil 4 is inserted into a hollow portion 3 defined by a winding portion. The first core 1 is covered with a pot-shaped third core 6. The first and second cores 1 and 5 are mounted on a base 7 and the third core 6 is fitted over the base 7. Terminal pins 8 are extended downwardly from the base 7. The magnetic path established by the control coil 2 is extended through the first and third cores 1 and 6 as indicated by the broken lines 9 while the magnetic path established by the tuning coil 4 is extended through the second core 5 and the first core 1 as indicated by the broken lines 10. Both the magnetic paths 9 and 10 are most superposed one upon another at the winding portion 11 of the second core 5. When a DC current or a low-frequency current is made to pass through the control coil 2 to vary a magnetic flux density, the effective permeability of the second core 5 is controlled, whereby the inductance of the tuning coil 4 can be varied. The variable ratio of inductance; that is, a value obtained by dividing a maximum value by a minimum value is increased when a low-frequency core having a high magnetic flux density is used as the first core. On the other hand, a high-frequency current passes through the tuning coil 4 so that a high-frequency core having a low magnetic flux density must be used as the second core 5 so as to minimize losses.

However, in the case of the variable inductor of the type described above with reference to FIG. 3, the magnetic path 10 established by the tuning coil 4 is extended into the first core so that the loss at the portion of the first low-frequency core at which the magnetic path 10 is established is increased. In addition, the increase in inductance and Q factor and a variable ratio of the tuning coil 4 is limited.

SUMMARY OF THE INVENTION

Objects

In view of the above, a first object of the present invention is to provide an electric-current-control type variable inductor in which the main magnetic path established by a tuning coil is extended only in a high-frequency core and does not exist in a low-frequency core so that losses in the cores can be reduced to a minimum.

A second object of the invention is to assemble a plurality of tuning coils in such a way that their characteristics can be simultaneously adjusted.

A third object of the present invention is to provide an electric-current-control type variable inductor which can be used at further higher frequencies.

A fourth object of the present invention is to vary the relative positions of the cores mounted with the tuning coil and the control coil, respectively, so that it becomes possible to accomplish fine adjustments of circuit constants such as inductance.

Technical Means for Solving Problems

In an electric-current-control type variable inductor of the type in which the winding portion of a second core is inserted into a hollow portion defined at the winding portion of a first core in such a manner that the winding portions of the first and second cores are in parallel with each other, the first core is inserted into a pot-shaped third core in such a way that the winding portion of the first core is maintained vertical to the bottom of the third core and the control coil mounted on the first core and the tuning coil mounted on the second core have their magnetic paths superposed at the winding portion of the second core, the present invention is characterized in that a portion in which is extended the magnetic path established by the tuning coil and a portion in which is extended the magnetic path established by the control coil are fabricated with relatively different materials in such a way that the former is fabricated from a high-frequency material while the latter, from a low-frequency material. More particularly, in the hollow portion, the second core is surrounded by a fourth core and the second and fourth cores are fabricated with a high-frequency material while the remaining component parts, with a low-frequency material. Furthermore when the second core is not surrounded by the fourth core, a portion through which is extended the magnetic path established by the tuning coil of the first core is locally made of a high-frequency material. The second core at which the magnetic paths established by the tuning and control coils is always made of a high-frequency material.

DESCRIPTION OF THE PREFERRED EMBODIMENTS

Figure 1:
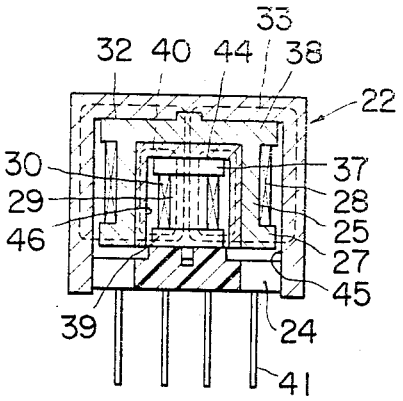
FIG. 1 is a vertical sectional view of a first embodiment of an electric-current-controlled type variable inductor in accordance with the present invention.
Figure 3:
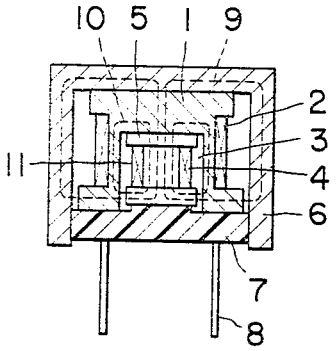
PRIOR ART FIG. 3
FIG. 3 is a view used to explain a prior art electric-current-controlled type variable inductor.
Figure 2:
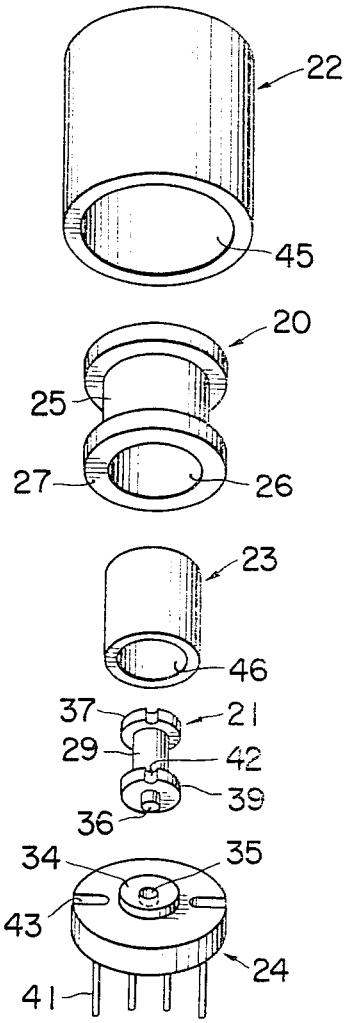
FIG. 2 is an exploded perspective view thereof.

A first embodiment of an electric-current-controlled type variable inductor in accordance with the present invention will be described below with reference to FIG. 1 illustrating a vertical sectional view thereof and to FIG. 2 illustrating an exploded perspective view except a coil.

In FIGS. 1 and 2, reference numerals 20 and 21 designate a first core and a second core, respectively; 22, a pot-shaped third core; 23, also a pot-shaped fourth core; and 24, a base. The first and third cores 20 and 22 are low frequency ferrite cores while the second and fourth cores 21 and 23 are high-frequency ferrite cores best adapted to operate at the frequency of the currents flowing through the tuning coil 30. The base 24 is made of a synthetic resin.

The first core 20 has circular flange formed integral with the upper and lower ends thereof and a winding portion 25 formed with a cylindrical hollow portion 26 having a circular cross sectional configuration. The lower circular flange of the first core 20 having an opening is designated as 27. A control coil 28 is mounted around the winding portion 25 and the fourth core 24 is fitted into the hollow portion 26.

The second core 21 has upper and lower circular flanges formed integral with the upper and lower ends thereof, respectively, and has a winding portion 29 around which is mounted a tuning coil 30. The second core 21 is inserted into the fourth core 23 in such a way that the winding portion 29 thereof is in parallel with the winding portion 25 of the first core 20. The whole structure of the second core 21 is covered with the fourth core 23.

The first core 20 is inserted into the third core 22 in such a way that the winding portion of the first core 20 is maintained vertical to the bottom 32 of the third core 22. The third core 22 confines the magnetic path 33 established by the control coil 28 therein and serves to prevent the divergence of the magnetic path 33.

A circular projection 34 is extended upwardly from the top surface of the base 24 coaxially thereof and is formed with a coaxial hole 35 into which is fitted a projection 36 of the second core 21. Terminal pins 41 for connection with the lead wires of the control coil 28 and the tuning coil 30 are extended downwardly from the bottom surface of the base 24. The upper flange 38 of the first core 20 and the bottom 32 of the third core 22 are made into contact with each other; the hollow portion 26 and the fourth core 23 are made into a contact with each other; and the bottom 44 of the fourth core 23 and the upper flange 37 of the second core 21 are made into contact with each other. Small spaces are left between the first core 20 and the inner cylindrical surface 45 of the third core 22 and between the second core 21 and the inner cylindrical surface 46 of the fourth core 23, and mylar (trademark) films may be inserted between the surfaces of contact and into the above-described spaces in order to ensure the stabilization of characteristics and the improvement of physical strength. The second core 21 is formed with a groove 42 and the base 24 is also formed with a groove 43 in order to extend the lead wires therethrough.

In the variable inductor with the above-described construction, the control coil 28 establishes the magnetic path 33 which, as indicated by the broken line, extends through the winding portion 29 and the upper flange 37 of the second core 21 and the fourth core 23, the upper flange 38 of the first core 20, the third core 22, the lower flange 27 of the first core 20 and the lower flange 39 of the second core 21. The magnetic path 40 established by the tuning coil 30 extends, as indicated, through the winding portion 29 and the upper flange 37 of the second core 21, the fourth core 23 and the lower flange 39 of the second core 21. The magnetic paths 33 and 40 are superimposed one upon another most densely at the winding portion 29 of the second core 21 so that when the effective permeability of the second core 21 is controlled by varying the magnetic flux density of the control coil 28 so that the inductance and the Q factor of the tuning coil 30 can be adjusted. Furthermore, since the magnetic path 40 established by the tuning coil 30 is mainly confined in the high-frequency cores of both the fourth and second cores 23 and 21, high-frequency losses can be reduced to a minimum. Moreover, the magnetic path 33 established by the control coil 28 is almost confined with the low-frequency first and second core 20 and 22 so that variations in magnetic flux density due to electric current can be increased. In addition, the inductance and the Q factor of the tuning coil 30 and their variations can be increased.

Figure 4:
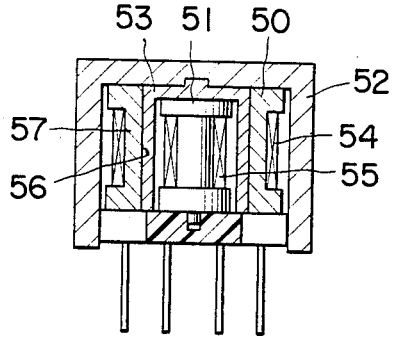
FIGS. 4, 5 and 6 are sectional views of second, third and fourth embodiments, respectively, of the present invention.
Figure 5:
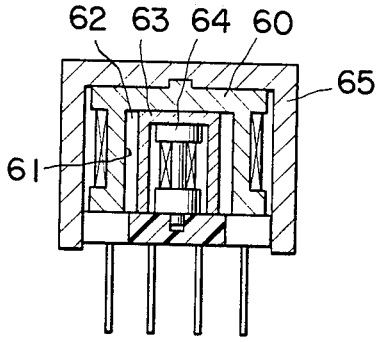
Figure 6:
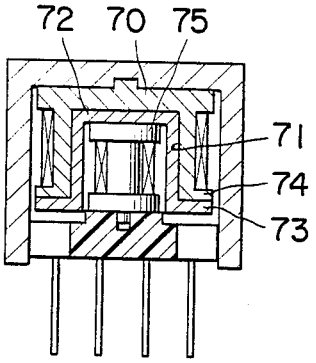

FIGS. 4, 5 and 6 are vertical views of a second, third and fourth embodiments, respectively, of the present invention.

In the second embodiment shown in FIG. 4, reference numeral 50 designates a first core; 51, a second core; 52, a third core; 53, a fourth core; 54, a control coil mounted on the first core 50; and 55, a tuning coil mounted on the second core 41. The hollow portion 56 of the first core 50 is extended through the winding portion 57 and the fourth core 53 is inserted into the hollow portion 56. The second core 51 is inserted into the fourth core 53. The magnetic path established by the tuning coil 55 extends within the high-frequency second core 51 and the fourth core 53 while the magnetic path established by the control coil 54 extends within the second core 51 and the first low-frequency core 50 and the third low-frequency core 52. As compared with the first embodiment described above with reference to FIGS. 1 and 2, the magnetic path is shortened in the low-frequency core while it is increased in length in the high-frequency core. It follows therefore that the inductance and the Q factor is increased while the variable ratio is decreased.

In the third embodiment shown in FIG. 5, two fourth cores are inserted into a first core 60. A cylindrical fourth core 62 is fitted into the hollow portion 61 and another fourth core 63 is fitted into the fourth core 62. The second core 64 and the fourth core 63 are operating best at a high frequency while the first core 60 and the third core 65 operates best at a low frequency. The fourth core 62 operates at an intermediate frequency so that the fine adjustments of the above-described characteristics can be accomplished.

In the fourth embodiment as shown in FIG. 6, a fourth core 72 is more snugly fitted into a cylindrical hollow portion 71 of a first core 70 and in order to enhance the stability of characteristics, the fourth core 72 which surrounds a second core 75 is formed with a lower flange 73 whose upper surface is maintained in contact with the lower surface of a lower flange 74 of the first core 70.

So far the fundamental embodiments of the electric-current-controlled type variable inductor in accordance with the present invention have been described. According to the present invention, therefore, at least one fourth core surrounding a second core mounted with a tuning coil is disposed in the cylindrical hollow portion of a first core mounted with a control coil so that the inductance, the Q factor and the variation ratio can be improved. That is, these characteristics are increased in value and can be maintained at high values, respectively, even at a high-frequency range as compared with the prior art variable inductors. In addition, the fourth cores (which is one or two in the above-described embodiments) which surround the second core may have various characteristics so that variable inductors in accordance with the present invention can have versatile characteristics.

Figure 7:
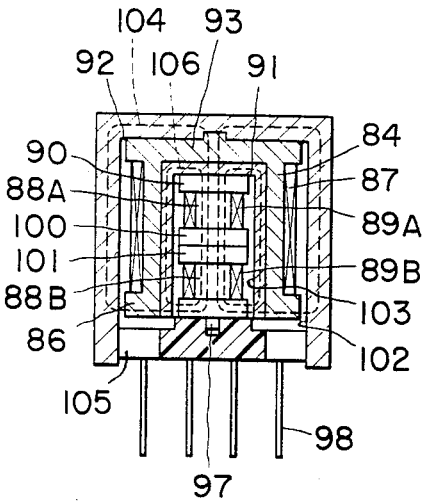
FIG. 7 is a vertical sectional view of a fifth embodiment of the present invention in which a plurality of tuning coils are used.
Figure 8:
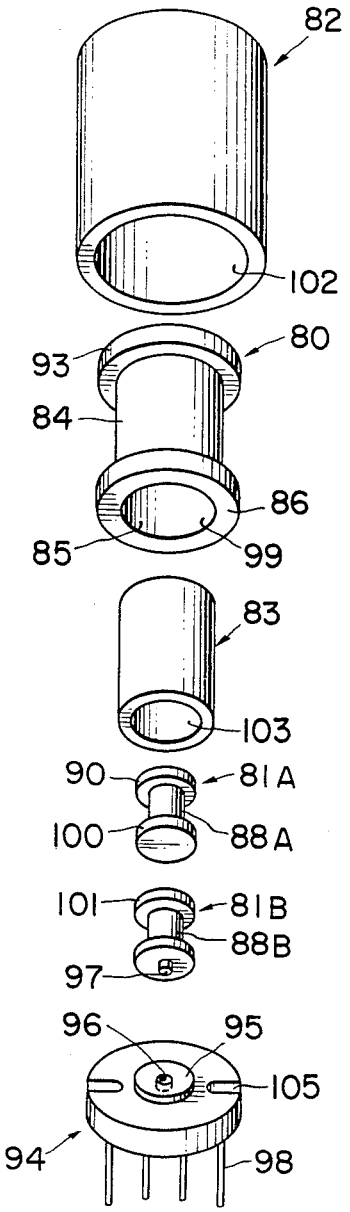
FIG. 8 is an exploded perspective view thereof.

Referring next to FIGS. 7 and 8, a fifth embodiment of the present invention in which a transformer is provided by combining a plurality of tuning coils which can be concurrently adjusted will be described.

FIG. 7 is a vertical sectional view of the fifth embodiment while FIG. 8 is an exploded perspective view thereof without coils.

In FIGS. 7 and 8, reference numeral 80 represents a first core; 81A and 81B, second cores; 82, a third core; and 83, a fourth core. All the cores mentioned above are made of a ferrite which is a magnetic material. That is, the first and third cores 80 and 82 are adapted to operate at a low-frequency while the second cores 81A and 81B and the fourth core 83 are made of a high-frequency ferrite best adapted to operate at the frequency of an electric current flowing through a tuning coil to be described below. The base 94 is made of a synthetic resin.

The winding portion 84 of the first core 80 with circular flanges is formed with a cylindrical hollow portion 85 having a circular cross sectional configuration and opening of the hollow portion 85 is surrounded by the lower flange 86. The winding portion 84 is mounted with a control coil 87. A pot-shaped fourth core 83 is inserted into the hollow portion 85.

The winding portion 88A of the second core 81A with circular flanges is mounted with a tuning coil 89A and in like manner, the winding portion 88B of the second core 81B is mounted with another tuning coil 89B. The lower flange 100 of the core 81A is made into contact with the upper flange 101 of the core 81A and 81B which are surrounded by the fourth core 83 are inserted into the hollow portion 85 in such a way that the winding portions 88A and 88B are maintained in parallel with the winding portion 84.

The first core 80 is fitted into the pot-shaped third core 82 in such a way that the winding portion 84 of the first core 80 is maintained perpendicular to the bottom 92 of the third core 82. The third core 82 confines therein the magnetic path 104 established by the control coil 87 and serves to prevent the divergence of the magnetic path 104.

A circular projection 95 is extended upwardly from the upper surface of the circular base 94 coaxially thereof and the projection 97 of the second core 81B is fitted into a hole 96 formed in the upwardly projected portion 95. Terminal pins 98 for connection with the lead wires of the control coil 87 and the tuning coils 89A and 89B are extended downwardly from the lower surface of the base 94. The second core 81B is securely mounted on the circular upward projection 95 of the base 94, whereby all the remaining cores are supported by the base 94.

The upper flange 93 of the first core 80 is made into contact with the bottom 92 of the first core 82; the inner cylindrical surface 99 of the hollow portion 85 is made into contact with the fourth core 83; the bottom 91 of the fourth core 83 is made into contact with the upper flange 90 of the second core 81A; and the lower flange 100 of the second core 81A is made into contact with the upper flange 101 of the second core 81B. Small spaces are left between the first core 80 and the inner cylindrical surface 102 of the third core 82 and between the second cores 81A and 81B and the inner cylindrical surface 103 of the fourth core 83, but mylar films or the like may be interposed between the surfaces of contact and into the spaces.

In the fifth embodiment with the above-described construction, the magnetic path 104 established by the control coil 87 extends, as indicated by the broken line, through the winding portion 88B of the second core 81B, the winding portion 88A of the second core 81A, the fourth core 83, the upper flange 93 of the first core 80 and the third core 82 mainly. On the other hand, the magnetic path 106 established by two tuning coils 89A and 89B mainly extends, as indicated by the broken line, through the winding poriton 88B of the second core 81B, the winding portion 88A of the second core 81A and the fourth core 83. The magnetic paths 104 and 106 are superposed one upon another most densely at the winding portion 88A of the second core 81A and the winding portion 88B of the second core 81B so that the effective permeability of each of the second cores 81A and 81B is controlled by varying the magnetic flux density produced by the control coil 87 so that the inductance and the Q factors of the tuning coils 89A and 89B can be simultaneously adjusted. Therefore when the tuning coils 89A and 89B are so combined as to constitute a transformer, the characteristics of the latter can be adjusted. When the fourth core 83 is fabricated from a metal, its dimensional accuracy can be improved. The second cores may be a single core having a flange at a midpoint between the ends thereof; that is, it may be in the form of an integral combination of the second cores 81A and 81B shown in FIG. 7. Alternatively, a plurality of tuning coils may be provided on second cores each having only one lower flange.

Figure 9:
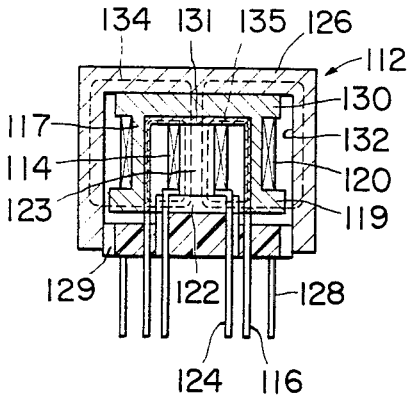
FIG. 9 is a vertical sectional view of a sixth embodiment of the present invention adapted to operate at high-frequency signals.
Figure 10:
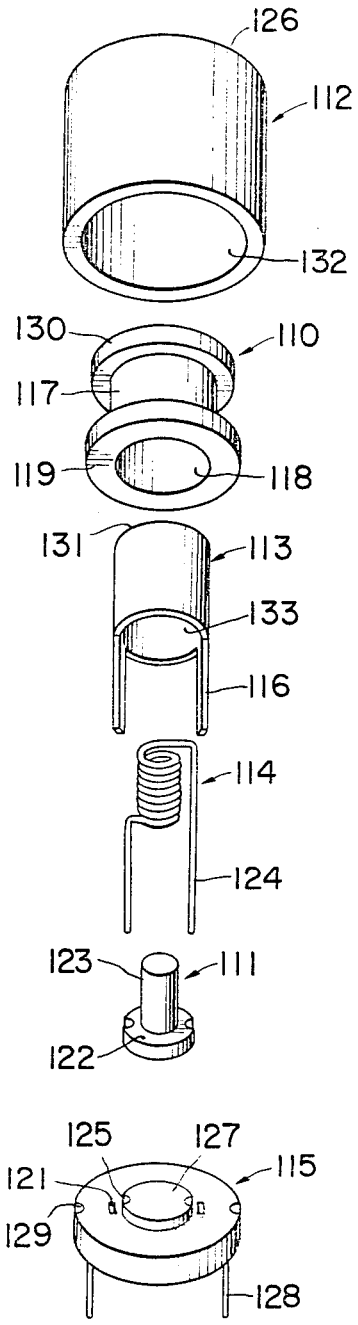
FIG. 10 is an exploded perspective view thereof.

Referring next to FIGS. 9 and 10, a sixth embodiment of an electric-current-controlled type variable inductor in accordance with the present invention which is best adapted to operate when the frequency of an electric current flowing through a tuning coil is further increased. FIG. 9 is a vertical sectional view thereof while FIG. 10 is an exploded perspective view thereof except coils.

In FIGS. 9 and 10, reference numeral 110 designates a first core; 111, a second core 112, a cylindrical pot-shaped third core; 113, a fourth core; 114, a tuning coil; and 115, a base. The first core 110 and the third core 112 are made of a ferrite adapted to operate at a low frequency while the second core 111 is made of a high-frequency ferrite best adapted to operate at the frequency of electric current flowing through the tuning coil 114. The fourth core 113 which is in the form of a cylindrical pot is made of a thin metallic magnetic material and has grounding terminals 116 extending downwardly from the lower end thereof. A metallic magnetic material is, for instance, permalloy.

The winding portion 117 of the first core 110 with upper and lower flanges is formed with a cylindrical hollow portion 118 having a circular cross sectional configuration and its opening is surrounded by the lower flange 119. The winding portion 117 is mounted with a control coil 120.

The fourth core 113 is inserted into the hollow portion 118 and its terminals 116 extend downwardly through two through-holes 121, respectively, of a base 115.

The winding portion 123 of the second core 111 with a lower flange 122 is mounted with a tuning coil 114 which is made of a wire having a relatively large diameter and which has end portions which can be used as terminals 124. More particularly, the tuning coil 114 is fitted over the winding portion 123 from the above and the terminals 114 are extended downwardly through through-holes formed through the bottoms of grooves 125 of the base 115. The second core 111 is inserted into the fourth core 113 in such a way that the winding portion 123 is maintained in parallel with the winding portion 117 of the first core 110 and the second core 111 is completely surrounded by the fourth core 113.

The first core 110 is inserted into the third core 112 in such a way that the winding portion 117 of the first core 110 is perpendicular to the bottom 126 of the third core 112.

The base 115 has a circular projection 127 extending from the top surface thereof and coaxially thereof and adapted to receive the lower flange 122 of the second core 111. The grooves 125 which are communicated with the through-holes are formed in the cylindrical side surface of the projection 127 and the through-holes 121 are located adjacent to the grooves 125, respectively. Terminal pins 128 are extended downwardly from the undersurface of the base 115 and are connected to the lead wires, respectively, of the control coil 120 which are extended through grooves 129, respectively. Mylar film or the like is interposed between the upper flange 130 of the first core 110 and the bottom 126 of the third core 112; between the upper flange 130 of the first core 110 and the bottom 131 of the fourth core 113; between the upper end of the winding portion 123 of the second core 111 and the bottom 131 of the fourth core 113; between the inner cylindrical surface 132 of the third core 112 and the lower flange 119 of the first core 110 and between the inner cylindrical surface 133 of the fourth core 113 and the lower flange 122 of the second core 111.

In the sixth embodiment of the variable inductor with the above-described construction, the magnetic path 134 established by the control coil 120 mainly extends, as indicated by the broken lines, through the winding portion 123 of the second core 111, the upper flange 130, the third core 112 and the flanges 119 and 122. On the other hand, the magnetic path 135 established by the tuning coil 114 mainly extends through the winding portion 123 of the second core 111, the fourth core 113 and the flange 122. Both the magnetic paths 134 and 135 are superimposed one upon another most densely at the winding portion 123 of the second coil 111 so that the effective permeability of the second core 111 is controlled by varying the magnetic flux density produced by the control coil 120, whereby the inductance and the Q factor of the tuning coil 114 can be adjusted. The tuning coil 114 which is made of a wire having a relatively large diameter has a less number of turns and the area between the opposing turns is narrow so that the line capacity can be reduced, thereby decreasing losses. Therefore, in addition to the reduction in losses in the fourth core 113 covering the second core 111 due to no extension of the magnetic path 135 through the winding portion 117 of the first core 110 adapted to operate at a low frequency, the inductance and the Q factor at a high frequency can be improved. When a fourth core 113 is made of a metal, its dimensional accuracies can be improved so that there is an advantage that the tuning coil 114 can be electromagnetically shielded from the exterior circuits by the earth terminals. Of course it is possible to fabricate the fourth core 113 from a ferrite or a superimposed combination of a metal and ferrite. It is apparent that the hollow portion of the first core 110 can be extended through the upper flange thereof and the characteristics of the variable inductor can be adjusted by suitably selecting the characteristics of the fourth core 113.

Figure 11:
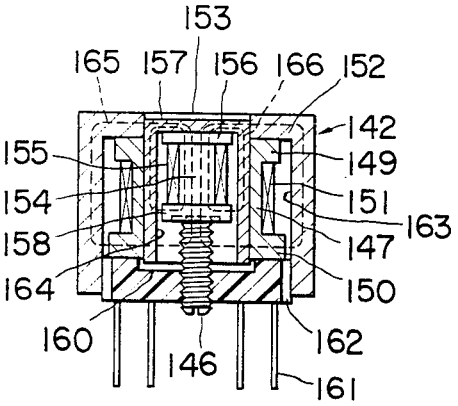
FIG. 11 is a vertical sectional view of a seventh embodiment of the present invention in which the position of a tuning coil in relation to a control coil is variable.
Figure 12:
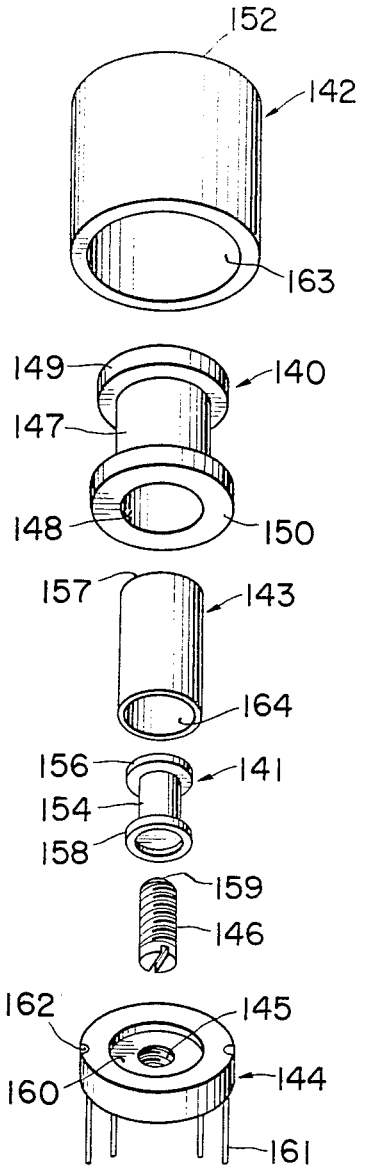
FIG. 12 is an exploded perspective view thereof.

Referring next to FIGS. 11 and 12, a seventh embodiment of an electric-current-controlled type variable inductor in accordance with the present invention in which the position of a core mounted with a tuning coil and the position of a core mounted with a control coil can be changed relative to each other will be described. FIG. 11 is a vertical sectional view thereof while FIG. 12 is an exploded perspective view thereof except coils.

In FIGS. 11 and 12, reference numerals 140 and 141 represent a first and a second core, respectively; and 142 and 143, cylindrical pot-shaped third and fourth cores, respectively. All the cores are made of a ferrite which is a magnetic material. The first and third cores 140 and 142 are made of a ferrite adapted to operate at a low frequency while the second and fourth cores 141 and 143 are made of a ferrite best adapted to operate at a high frequency of electric current flowing through a tuning coil to be described below.

A base 144 and a screw 146 for threadable engagement with a hole 145 of the base 144 are made of a synthetic resin.

The first core 140 has a winding portion 147 which is formed with a cylindrical hollow portion 148 which has a circular cross sectional configuration and extending through the upper and lower flanges 149 and 150 of the first core 140. The winding portion 147 is mounted with a control coil 151.

The bottom 152 of the third core 142 is formed with a coaxial through hole 153 whose diameter is equal to that of the cylindrical hollow portion 148 of the first core 140.

The first core 140 is inserted into the third core 142 in such a way that the hollow portion 148 is maintained in coaxial relationship with the through-hole 153 of the third core 142 and that the winding portion 147 of the first core 140 is maintained perpendicular to the bottom 152 of the third core 142. The third core 142 is fitted over the base 144 and is securely maintained in position by the first core 140.

The fourth core 143 is fitted into the hollow portion 148 of the first core 140.

The winding portion 154 of the second core 141 with an upper flange 156 and a lower flange 158 is mounted with a tuning coil 155 and the second core 141 is fitted into the fourth core 143 which in turn is fitted into the hollow portion 148 of the first core 140. The upper flange 156 of the second core 141 is put into very intimate contact with the bottom 157 of the fourth core 143 while the lower flange 158 thereof is supported by the upper end 159 of the screw 146 for threadable engagement with the center hole 145 of the base 144. Upon rotation of the screw 146, the second core 141 is caused to move vertically through the cylindrical hollow portion 148 of the first core 140 and the through-hole 153 of the third core 142 in unison with the fourth core 143. Even when the screw 146 is rotated, the second core 141 which is securely fixed to the fourth core 143 will not rotate. In order to prevent the rotation of the second core 141 and the fourth core 143 due to the rotation of the screw 146, the hollow portion 148 of the first core 140 is defined to have a rectangular cross sectional configuration or formed with a groove into which is inserted a projection to prevent the rotation of the second and fourth cores 141 and 143.

The recess 160 in the top surface of the base 144 is provided in order to increase the vertical shift of the fourth core 143. Terminal pins 161 are connected to the lead wires of the tuning coil 155 and the control coil 151 extending through grooves 162 of the base 144.

Mylar films or the like are interposed between the upper flange 149 of the first core 140 and the contact surface of the bottom 152 of the third core 142; between the upper flange 156 of the second core 141 and the contact or joint surface of the bottom 157 of the fourth core 143; and between the inner surface 163 of the third core 142 and the low flange 150 of the first core 140.

In the seventh embodiment with the above-described construction, the magnetic path 165 established by the control coil 151 mainly extends, as indicated by the broken lines, through the winding portion 154 of the second core 141, the bottom 157 of the fourth core 143, the third core 142, the lower flange 150 of the first core 140, the inner surface 164 of the fourth core 143 and the lower flange 158 of the second core 141. On the other hand, the magnetic path 166 established by the tuning coil 155 mainly extends through the winding portion 154 of the second core 141, the fourth core 143 and the lower flange 158 of the second core 141. As a result, the magnetic paths 165 and 166 are superimposed one upon another most densely at the winding portions 154 of the second core 141 so that when the effective permeability of the second core 141 is controlled by varying the magnetic flux produced by the control coil 151, the inductance and the Q factor of the tuning coil 155 can be adjusted. When the magnetic paths 165 and 166 are moved toward or away from each other by turning the screw 146, thereby shifting the tuning coil 155, the maximum and minimum values of the inductance and the Q factor, respectively, and constants of whole characteristics such as a degree of variation in inductance or the Q factor are obtained. Therefore, after the assembly, the characteristics can be adjusted to attain a desired circuit constant without changing the design over a wide range. Thus the seventh embodiment is very versatile in practical applications.

In the seventh embodiment, the position of the fourth core 143 greatly affects the maximum and minimum values of the inductance and the Q factor, respectively, while the position of the second core 141 greatly influences the variation ratio, that is, a value obtained when a maximum value is divided by a minimum value. Furthermore, the fourth core 143 serves to extend the magnetic path 166 established by the tuning coil 155 into the high-frequency core so that the high-frequency losses can be reduced to a minimum and the above-described characteristics can be satisfactorily maintained at high levels even at high frequencies. When the fourth core 143 is fabricated from a metal, its dimensional accuracies are improved in comparison with the case when it is made of a ferrite.

The hollow portion 148 is extended through the first core 140 while the hole 153 is extended through the third core 142, but it is possible to permit the movement of the second core only with the hollow portion of the first core 140. A plurality of tuning coils may be used. In addition to the screw 146, another screw may be provided so as to shift the fourth core 143 independently of the second core 141.

Figure 13:
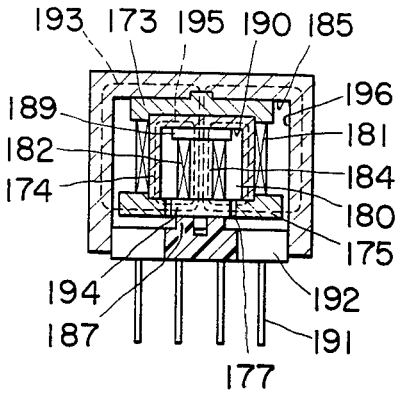
FIG. 13 is a vertical sectional view of an eighth embodiment of the present invention without incorporating a fourth core.

In the embodiments described above, it has been explained that the second core is covered with the fourth core, but referring next to FIGS. 13 and 14, an eighth embodiment of the present invention in which the second core is not covered with the fourth core and a part of the first core through which extends the magnetic path established by the tuning coil is made of a high-frequency material will be described. FIG. 13 is a vertical sectional view thereof while FIG. 14 is an exploded perspective thereof.

Figure 14:
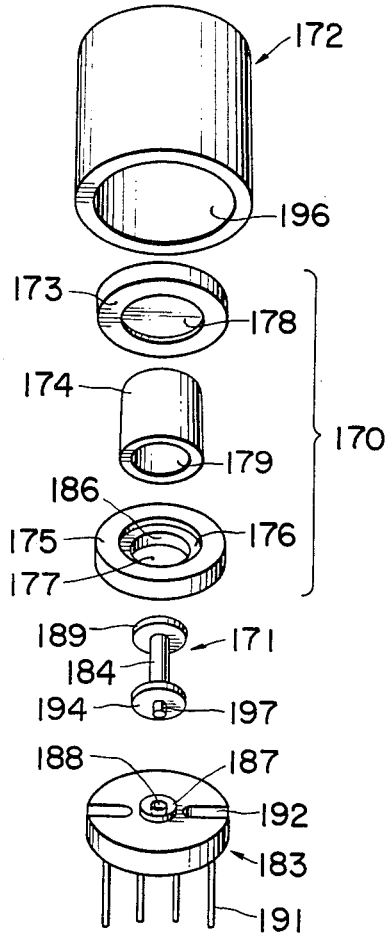
FIG. 14 is an exploded perspective view thereof.

In FIGS. 13 and 14, reference numerals 170 and 171 represent a first and a second core, respectively; and 172, a pot-shaped third core. The upper flange 173, a pot-shaped winding portion 174 and the lower flange 175 of the first core 170 are fabricated separately and assembled as shown in FIG. 13. The inner cylindrical surface of the annular flange 175 is defined with an annular stepped portion 176 coaxially therewith at a position spaced apart downwardly from the upper surface thereof by a suitable distance and a through-hole 177 is formed through the annular stepped portion 175 coaxially thereof. The lower surface of the upper flange 173 is formed with a circular recess 178 coaxially thereof. A cylindrical winding portion 174 has its upper closed end securely fitted into the circular recess 178 of the upper flange 173 and has an opened end securely joined to the stepped portion 176. The inner cylindrical surface 179 of the winding portion 174 and the lower flange 175 define a hollow portion 180 of the first core 170. The winding portion 174 is mounted with a control coil 181. The upper and lower flanges 173 and 175 and the third core 172 are made of a ferrite best adapted to operate at a low frequency while the winding portion 174 and the second core 171 are made of a high-frequency ferrite best adapted to operate at the frequency of an electric current flowing through a tuning coil 182. A base 183 is made of a synthetic resin.

The winding portion 184 of the second core 171 with the upper and lower flanges 189 and 194 is mounted with the tuning coil 182 and the second core 171 is inserted through the through-hole 177 of the lower flange 175 into the hollow portion 180 in such a way that the winding portion 184 of the second core 171 is maintained in parallel with the winding portion 174 of the first core 170.

The first core 170 is inserted into the third core 172 in such a way that the winding portion 174 of the first core 170 is maintained perpendicular to the bottom 185 of the third core 172.

A circular projection 187 is extended upwardly from the upper surface of the base 183 and has a coaxial hole 188 into which is fitted the projection 197 of the second core 171. Terminal pins 191 for electrical connection with the lead wires of the control and tuning coils 181 and 182 are extended downwardly from the undersurface of the base 183. The upper flange 173 of the first core 170 is made into contact with the bottom 185 of the third core 172; the bottom 190 of the winding portion 174 is made into contact with the upper flange 189 of the second core 171; a small space is left between the lower flange 175 of the first core 170 and the inner surface 196 of the third core 172; and also a small space is left between the lower flange 194 of the second core 171 and the inner cylindrical surface 186 of the through-hole 177 of the lower flange 175. It is possible to insert Mylar films or the like between such contacts and into the spaces. The base 183 is formed with grooves 192 through which are extended lead wires.

In the eighth embodiment with the above-described construction, the magnetic path 193 established by the control coil 181 mainly extends, as indicated by the broken lines, through the winding portion 184 of the second core 171, the winding portion 174, the upper flange 173, the third core 172, the lower flange 175 and the lower flange 194 of the second core 171. On the other hand, the magnetic path 195 established by the tuning coil 182 mainly extends through the winding portion 184 of the second core 171, the winding portion 174 and the lower flange 194. Therefore the magnetic paths 193 and 195 are superimposed one upon another most densely around the winding portion 184 of the second core 171 so that when the effective permeability of the second core 171 is controlled by varying the magnetic flux produced by the control coil 181, the inductance and the Q factor of the tuning coil 182 can be adjusted.

So far the winding portion 174 of the first core 170 has been described as being in the form of a pot, but it is to be understood that a cylindrical winding portion may be equally used. Furthermore, a plurality of tuning coils may be used. The control coil 181 is directly wound around the winding portion 174, but it is also possible to fit a prefabricated control coil over the winding portion 174. Adjustments of characteristics can be attained by the removal of the upper flange 173.

In the electric-current-controlled type variable inductor of the type described above, the winding portion of the second core is fabricated separately from other component parts and then assembled therewith so that the material of the core of the winding portion in which the magnetic path is defined by the tuning coil can be freely selected. As a result, when a high-frequency core best adapted to operate at the frequency of an electric current flowing through the tuning coil is selected, the high values of inductance and the Q factor can be maintained even at high frequencies.

In addition, when the winding portion is fabricated separately, the first core can be fabricated without the use of the cutting process so that the thickness of the side wall of the winding portion can be reduced so that the coupling between the tuning and control coils at this portion can be enhanced, whereby the variation ratio can be advantageously increased.

Technical Effects

As described above, in the electric-current-controlled type variable inductors in accordance with the present invention, different materials are used to define a portion through which is extended the magnetic path established by the control coil and a portion through which is extended the magnetic path established by the control coil. Therefore, especially losses in the core through which is extended the magnetic path established by the tuning coil can be reduced to a minimum. As a result, the inductance, the Q factor and the variation ratio can be increased. Furthermore, as described in conjunction with the embodiments, various additional effects can be attained.

Furthermore, the practical operating frequency range can be increased from the conventional 2 MHz to the order to 120 MHz.

What is claimed is:

1. An electric-current-controlled type variable inductor comprising a first core having a winding portion formed with a hollow portion, a second core inserted into said hollow portion of said first core such that the winding portion of said second core is maintained in parallel with the winding portion of said first core, a pot-shaped third core having said first core inserted therein such that the winding portion of said first core is maintained vertical to the bottom of said third core and the magnetic path established by a control coil mounted on said first core and the magnetic path established by a tuning coil mounted on the second core are superimposed one upon another at the winding portion of said second core, a first electromagnetic portion for substantially covering said second core, through which is extended the magnetic path established by said tuning coil and said second core, said first electromagnetic portion being made of a high-frequency material, and a second electromagnetic portion through which is extended the magnetic path established by said control coil, said second electromagnetic portion being made of a low-frequency material.

2. An electric-current-controlled type variable inductor comprising a first core having a winding portion formed with a hollow portion, at least one second core inserted into said hollow portion of said first core such that the winding portion of said second core is maintained in parallel with the winding portion of said first core, a pot-shaped third core into which said first core is inserted such that the winding portion of said first core is maintained vertical to the bottom of said third core and the magnetic path established by a control coil mounted on said first core and the magnetic path established by a tuning coil mounted on said second core are superimposed one upon another around the winding portion of said second core, said second core in said hollow portion being covered by at least one fourth core through which is extended the magnetic path established by said tuning coil and which is made of a high-frequency material.

3. An electric-current-controlled type variable inductor as set forth in claim 2, wherein said at least one second cores mounted with a plurality of tuning coils are disposed in said hollow portion of said first core.

4. An electric-current-controlled type variable inductor as set forth in claim 2, wherein said tuning coil is made of a wire having a relatively large diameter and its ends serve as terminals; and said second core is covered with said fourth core made of a metallic magnetic material.

5. An electric-current-controlled type variable inductor as set forth in claim 2, wherein said second core is vertically movably disposed in said hollow portion.

6. An electric-current-controlled type variable inductor as set forth in claim 2, wherein said first core has a through-hole at its winding portion and said third core has an opening at its upper bottom surface, and said second core covered with said fourth core is supported by a base so as to be movable upwardly and downwardly within said through-hole of said first core and said opening of third core coinciding in their positions with respect to each other.

7. An electric-current-controlled type variable inductor comprising a first core having a winding portion formed with a hollow portion, a second core inserted into said hollow portion such that the winding portion of said second core can be maintained in parallel with the winding portion of said first core, a pot-shaped third core having said first core inserted therein such that the winding portion of said first core can be maintained vertical to the bottom of said third core and the magnetic path established by a control coil mounted on said first core and the magnetic path established by a tuning coil mounted on said second core are superimposed one upon another around the winding portion of said second core, said first core consisting of a winding portion which is made of a high-frequency material and through which the magnetic path established by said tuning coil is extended, and another portion.

8. An electric-current-controlled type variable inductor as set forth in claim 1, wherein said third core is made of a low-frequency magnetic material and said first core comprises both high-frequency magnetic material and low-frequency magnetic material in different adjoined locations.

9. An electric-current-controlled type variable inductor as set forth in claim 8, wherein said winding portion of said first core is made of a high-frequency magnetic material such that said magnetic path of said tuning coil extends through said winding portion of said first core.

* * * * *